US011581174B2

(12) United States Patent
Böhm et al.

(10) Patent No.: US 11,581,174 B2
(45) Date of Patent: Feb. 14, 2023

(54) METHOD OF OPERATING A SECONDARY-ELECTRON MULTIPLIER IN THE ION DETECTOR OF A MASS SPECTROMETER

(71) Applicant: Bruker Daltonics GmbH & Co. KG, Bremen (DE)

(72) Inventors: Sebastian Böhm, Bremen (DE); Andreas Haase, Bremen (DE); Jens Höhndorf, Bremen (DE)

( * ) Notice: Subject to any disclaimer, the term of this patent is extended or adjusted under 35 U.S.C. 154(b) by 0 days.

(21) Appl. No.: 17/334,972

(22) Filed: May 31, 2021

(65) Prior Publication Data

US 2021/0287891 A1 Sep. 16, 2021

Related U.S. Application Data

(63) Continuation of application No. 16/359,491, filed on Mar. 20, 2019, now Pat. No. 11,049,705.

(30) Foreign Application Priority Data

Mar. 29, 2018 (DE) ..... 102018107529.4

(51) Int. Cl.
*H01J 49/40* (2006.01)
*H01J 49/02* (2006.01)
*H01J 49/00* (2006.01)

(52) U.S. Cl.
CPC ..... *H01J 49/022* (2013.01); *H01J 49/0031* (2013.01); *H01J 49/025* (2013.01); *H01J 49/40* (2013.01)

(58) Field of Classification Search
CPC ..... H01J 49/025; H01J 49/40
See application file for complete search history.

(56) References Cited

U.S. PATENT DOCUMENTS

| | | | | |
|---|---|---|---|---|
| 4,883,957 | A * | 11/1989 | Kinge | H01J 49/025 250/281 |
| 5,757,005 | A * | 5/1998 | Callas | G01T 1/2928 250/363.06 |
| 6,674,068 | B1 * | 1/2004 | Kammei | H01J 49/40 250/397 |
| 2009/0294643 | A1 * | 12/2009 | Steiner | H01J 49/025 250/281 |
| 2017/0047213 | A1 * | 2/2017 | Hayashi | H01J 43/246 |

* cited by examiner

*Primary Examiner* — Eliza W Osenbaugh-Stewart
(74) *Attorney, Agent, or Firm* — Benoit & Côté Inc.

(57) ABSTRACT

The disclosure relates to a method of operating a secondary-electron multiplier in the ion detector of a mass spectrometer so as to prolong the service life, wherein the secondary-electron multiplier is supplied with an operating voltage in such a way that an amplification of less than $10^6$ secondary electrons per impinging ion results, while the output current of the secondary-electron multiplier is amplified using an electronic preamplifier mounted close to the secondary-electron multiplier with such a low noise level that the current pulses of individual ions impinging on the ion detector are detected above the noise at the input of a digitizing unit. Further disclosed are the use of the methods for imaging mass spectrometric analysis of a thin tissue section or mass spectrometric high-throughput analysis/massive-parallel analysis, and a time-of-flight mass spectrometer whose control unit is programmed to execute such methods.

20 Claims, 5 Drawing Sheets

METHOD OF OPERATING A SECONDARY-ELECTRON MULTIPLIER IN THE ION DETECTOR OF A MASS SPECTROMETER

BACKGROUND OF THE INVENTION

Field of the Invention

The invention relates to the electronic incorporation of secondary-electron multipliers (SEM) in ion detectors of mass spectrometers.

Description of the Related Art

Several types of windowless secondary-electron multipliers (often called "multipliers" for short) can be used in mass spectrometers to measure very low ion currents. What they all have in common is that they age when operated in the vacuum of the mass spectrometer. The amplifications of commercially available multipliers can be adjusted over a wide range, in the extreme case between $10^4$ and $10^8$ (typically $10^6$), by changing the operating voltage, although operating the multiplier at high voltages causes them to age very quickly. According to current thinking, aging occurs because the coatings on the dynodes are changed by the electron avalanches, and this increases the work function of the specially conditioned surfaces and reduces the yield of secondary electrons. For some types of multipliers, the change to the surfaces can be observed as a discoloration. The rate of change of the coatings very probably depends on the current density of the impinging electrons, but also on their impact energy, so the change occurs more rapidly when the operating voltage is higher, even when the same electron current, i.e. the same amplification, is set. The reduction in amplification caused by aging can be compensated by raising the operating voltage, but this increasingly intensifies the aging process and increasingly reduces the remaining service life.

This aging of the secondary-electron multiplier is not simply a function of time, but a function of the length of time they are used. For some types of multipliers, the service life also depends on the type and energy of the ions which produce the first generation of electrons. Further parameters involved in the aging process are temperature, periods of rest between phases of operation, type of residual gas in the vacuum, venting phases, and others. The amplification of the multipliers, which depends on the voltage applied, must therefore be reset over the course of time by increasing the operating voltage. When the upper limit of the operating voltage is reached, the amplification can no longer be readjusted and the multiplier has to be replaced.

Having to frequently replace the multiplier is not only costly, but also annoying because operation is interrupted, and this can last many hours or even several days after the mass spectrometer has been vented. The manufacturer's service department frequently has to be involved also.

Particularly annoying is the aging of the multipliers in time-of-flight mass spectrometers which are used to acquire hundreds of thousands of mass spectra for the imaging mass spectrometry of thin tissue sections. Here, the multipliers sometimes do not even survive the acquisition of the spectra for a single thin tissue section with an area of only a few square centimeters. In the case of support plates with a large number of separate sample preparations, as are used for high-throughput analysis or massive-parallel analysis, e.g. with 1536 or more separate sample sites, signs of aging can also become noticeable when all the individual samples on the plate are analyzed in rapid succession.

The oldest type of secondary-electron multipliers designed by J. S. Allen, which are still in use today, consists of 8 to 18 discrete dynodes (sometimes even more), between which voltages in the order of 100 to 200 volts per pair of dynodes are applied by means of a voltage divider. The surfaces of the dynodes are conditioned in a particular way to generate a low work function and thus a high yield of secondary electrons. The ions impinge on the first dynode, where they generate secondary electrons, which are accelerated and then impinge onto the second dynode. Each of these electrons then generates several secondary electrons on average, so that an avalanche of electrons forms along the dynodes. The amplification is the number of electrons from the final dynode per ion which impinges onto the first dynode. The dynodes can be shaped so that the times taken for the secondary electrons to fly from one dynode to the next are roughly the same for all electrons. This makes it possible for the full width at half-maximum of the emerging electron pulse, which originates from a single primary ion, to be only around 0.5 nanoseconds or even less. This allows high mass resolutions of R=50,000 and more to be achieved in time-of-flight mass spectrometers despite high acquisition rates of 10,000 mass spectra per second with a measuring rate of around 4 giga-samples per second.

Other types of secondary-electron multiplier are the so-called "channeltron multipliers" and the multichannel plates. Channeltrons are not an option as detectors for time-of-flight mass spectrometers because the penetration depths of the ions vary by many millimeters, and this creates variations in the path lengths. They are used in 3D quadrupole ion trap mass spectrometers, for example. The multichannel plates have channel diameters of two to six micrometers, and are usually supplied in embodiments consisting of two plates, one behind the other, with channel directions at a slight angle to each other (chevron arrangement). In both these types of secondary-electron multiplier, voltage drops exist across the surface of the internal channels which, given an appropriate shape and surface conditioning, lead to electron avalanches in the channels. The amplification ranges are similar to those of dynode secondary-electron multipliers. FIG. 1 shows the characteristic curve for a double multichannel plate with channels only two micrometers in diameter. The aging process has the same causes and effects as with dynode multipliers, but is typically restricted to the second multichannel plate. These multichannel plate multipliers are also very fast. The full widths at half-maximum of the exiting electron pulses for one primary ion are less than one nanosecond. However, the varying penetration depths of the ions into the individual small channels create a problem here also, with variations in the penetration depths of up to 30 micrometers. Likewise, the unevenness of the surface of the multichannel plates can also generate a variation in the path length of up to 30 micrometers. For a time-of-flight mass spectrometer with a two-meter flight path, the times of flight of ions of the same mass can therefore vary by around 30 ppm (parts per million) because of the different path lengths, and thus restrict the mass resolution and the accuracy of the mass determination.

To eliminate the variation in the penetration depths, it is possible to have the ions impinge on a very flat conversion plate and to direct the emerging secondary electrons by magnetic means onto an SEM. An example for such an arrangement is the secondary-electron multiplier called MagneTOF™ from ETP Electron Multipliers Pty. Ltd. (Australia). The multiplier provides a high mass resolution and high mass accuracy but could be susceptible to aging processes.

Secondary-electron multipliers have characteristic curves which display the logarithm of the amplification as a function of the supply voltage. The characteristic curves are more or less straight, i.e., an increase in the supply voltage by a value ΔV increases the amplification by a factor F, regardless of the output voltage. Aging changes the position of the characteristic curve. When the characteristic curve is known, an aging-induced decrease in the amplification by a factor F can therefore be compensated again to a certain extent by increasing the voltage by ΔV.

Various measures can be taken to prolong the service life of multipliers. The disclosure WO 2012/021652 A2 (E. Kneedler and J. H. Orloff) proposes that the electrons from a first conversion plate be distributed over the total surface of a multichannel plate so that the plate is utilized uniformly. This measure is based on the assumption that the aging depends on the density of the impinging streams. The applicant was not able to confirm this assumption with its own investigations, however.

In the disclosure EP 2 680 295 A2 (A. Graupner et al.), the secondary electron streams from a conversion plate can be directed interchangeably to two separate multichannel plates, which is intended to double the service life of the arrangement.

In the disclosure US 2017/0025265 A1 (A. N. Verenchikov and A. Vorobyev), a photomultiplier which uses an Allen-type dynode multiplier in an evacuated glass tube is utilized in a time-of-flight mass spectrometer. The very pure vacuum in the tube means that the service life is much longer than that of a multiplier operated in the vacuum of the mass spectrometer. A magnetic field guides the secondary electrons of a conversion plate onto a scintillator which is positioned in front of the photomultiplier. Unfortunately, these measures cause the full width at half-maximum of the electron avalanche from a single ion to be broadened to around 5 nanoseconds, which greatly reduces the mass resolution that can be achieved for the above-described acquisition conditions for time-of-flight mass spectra. In addition, a slowly decaying current of around 15% is produced, which originates from slower fluorescence processes in the scintillator.

This use of a photomultiplier without an upstream multichannel plate does not, however, take into account the fact that the first multichannel plate practically does not age. It is therefore possible to place a multichannel plate in front of a high-speed photomultiplier without significant aging. Such an arrangement is supplied by Photonis (USA) under the name "BiPolar TOF Detector". Two different versions are offered, one of which operates at a particularly high speed with a pulse width of 0.7 nanoseconds, while the other is slightly slower at 1.7 nanoseconds, but has a particularly large dynamic measurement range. Both versions suffer from the problem of varying penetration depths, however.

Adjusting the amplification of a secondary-electron multiplier in a mass spectrometer generally presents major difficulties. Most mass spectrometers can measure neither the quantity of ions generated in the ion source nor the amplification of the SEM individually, but the two can compensate each other over a wide range. If the signal is too large, it is therefore scarcely possible to determine whether too many ions are being generated or whether the amplification of the SEM is set too high by too high an operating voltage. A high amplification of the SEM is damaging, however. Firstly, it shortens the life of the SEM and, secondly, the mass spectrum becomes unnecessarily noisy because too few ions are measured. The problem is aggravated by the fact that the amplification of a secondary-electron multiplier does not remain constant over its lifetime but is constantly changing when in operation as a result of aging processes. These changes can be continuous, but can also occur in steps of various sizes.

The problem occurs with completely different mass spectrometers with different types of secondary-electron multipliers. High-frequency Paul trap mass spectrometers are frequently equipped with dynode multipliers, for example, and often with channeltron detectors, also. MALDI time-of-flight mass spectrometers operate primarily with multichannel plates. The type of SEM is not relevant here. The problem lies solely in the fact that the rate of ion generation or ion filling and the amplification of the SEM compensate each other in such a way that the SEM amplification cannot be determined on its own.

Nor is it usual for the mass spectrometers to have any other types of measurement devices for ion currents which could be used to determine the amplification of the secondary-electron multiplier.

The problem is solved by a method which is explained in the patent specification DE 10 2008 010 118 B4 (A. Holle, corresponding to GB 2457559 B or U.S. Pat. No. 8,536,519 B2). The method consists in generating mass spectra with separate single ion signals, determining the average value of the peak heights of these single ion signals, and adjusting the amplification of the secondary-electron multiplier so that the peak height assumes a desired average value. The amplification is set via the operating voltage of the secondary-electron multiplier and can easily be increased or decreased by a desired factor, using a voltage difference, if the characteristic curve of the secondary-electron multiplier is known.

The patent specification DE 10 2008 010 118 B4 and all its content is incorporated herein by reference.

An objective of the invention is to extend the service life of a secondary-electron multiplier in the ion detector of a mass spectrometer by using a particular mode of operation.

SUMMARY OF THE INVENTION

The service life of a secondary-electron multiplier (multiplier, SEM) can be greatly extended if one succeeds in operating it at a voltage which is far below the usual operating voltage of SEMs. If the multiplier is operated with an amplification of $10^5$ or even only $2\times10^4$, for example, instead of the usual amplification of around $10^6$, it should be possible to extend the service life by a factor of three to five, since the service life depends to a great extent on the current intensity of the emitted electrons and the amplitude of the operating voltage.

However, at a low operating voltage, the pulse current of secondary electrons generated by a single ion is not sufficient to produce a digital signal which clearly stands out from the noise and can be unambiguously identified at the input of the digitizing unit. The digitizing unit, which operates at a digitizing rate of around four giga-samples per second or more, is housed in the computer of the mass spectrometer for reasons of speed for storing the digital values; this computer can be located several meters from the mass spectrometer itself in some cases. Additional electronic noise is generated by the long lead carrying the output signal of the SEM to the computer, usually via a 50Ω coaxial cable. In more favorable cases, the digitizing unit is accommodated in a plug-in module in the mass spectrometer itself, allowing the lead to be reduced to around half a meter to one meter.

In brief, the disclosure relates in particular to a method of operating a secondary-electron multiplier in the ion detector of a mass spectrometer so as to prolong the service life, wherein the secondary-electron multiplier is supplied with an operating voltage in such a way that an amplification of significantly less than $10^6$ secondary electrons per impinging ion results. The output current of the secondary-electron multiplier is amplified by means of an electronic preamplifier mounted close to the secondary-electron multiplier with such a low noise level that the current pulses of individual ions impinging on the ion detector are detected above the noise at the input of a digitizing unit.

The inventors recognized that the signal-to-noise ratio at the input of the digitizing unit can be improved by amplifying the output signal of the SEM with a sufficiently low noise level by means of a preamplifier located close to the SEM, preferably even in the vacuum system of the mass spectrometer, or at least on the housing of the vacuum system, (e.g. flange-mounted there, close to the detector), and by operating the SEM at a correspondingly lower operating voltage so that the service life of the SEM is prolonged many times over. The preamplifier must, however, operate at a high enough speed so as not to distort the electron current pulses. Preamplifiers of this type are commercially available, see for example the TA2400 model from FAST ComTech GmbH (Oberhaching, Germany). If required, the preamplifier must also be designed so that it can be operated in a vacuum. Operating a preamplifier in a vacuum produces particularly low noise.

In various embodiments, the amplification of the secondary-electron multiplier can be set to be less than $10^5$, preferably less than $2\times10^4$, secondary electrons per impinging ion. This measure significantly reduces the energy input produced by the electron avalanche, which usually changes the surface coatings of secondary-electron multipliers, and thus prevents aging processes or at least slows them down.

In various embodiments, the low-noise amplification can be achieved by mounting the preamplifier close to the secondary-electron multiplier in the vacuum system of the mass spectrometer, or at least on the housing of the vacuum system (e.g. flange-mounted there, close to the detector). The low-noise amplification is preferably achieved by mounting the preamplifier less than 40 centimeters, particularly less than 30 centimeters, from the secondary-electron multiplier. A short signal line offers significantly less opportunity for external interferences to introduce noise into a signal transmission. The low-noise characteristic of the preamplifier can be improved by cooling, for example with the aid of a Peltier element or other suitable cooling element.

The patent application laid open to inspection DE 10 2008 064 246 A1 (Korea Basic Science Institute; corresponding to US 2009/0166533 A1) describes a Fourier transform ion cyclotron resonance mass spectrometer where a preamplifier is installed in a vacuum chamber as close as possible to an ion cyclotron resonance cell. The thermal noise generated in the preamplifier is minimized with the aid of a cryo-cooling system in order to improve the signal-to-noise ratio of ion detection signals so that an ultra-small quantity of a sample can be analyzed. Ion cyclotron resonance mass spectrometers operate with image charge transients of ions excited on orbits in the magnetic field of the cell, however, and require no signal amplification by means of secondary-electron multipliers, which is the reason why their operation and aspects of aging play no part in the disclosure of DE 10 2008 064 246 A1.

In various embodiments, an adjustment of the amplification can be inserted, at specific times of operation of the secondary-electron multiplier via the acquisition of a mass spectrum with individual ion signals, while the operating voltage of the secondary-electron multiplier is lowered to such an extent that the signals of the individual ions stand out from the electronic noise just enough to be recognizable. In particular, the desired amplification of the secondary-electron multiplier can be set via a characteristic curve, which reflects the logarithm of the amplification as a function of the operating voltage.

The operating voltage can be set with the aid of a method which is explained in the above-mentioned patent specification DE 10 2008 010118 B4 (corresponding to GB 2457559 B or U.S. Pat. No. 8,536,519 B2). The method consists in generating mass spectra with single ion signals, determining the average value of the peak heights of these single ion signals, and adjusting the amplification of the secondary-electron multiplier so that a desired average value of the peak heights, and thus a desired amplification, is achieved. The desired amplification is set via the operating voltage with the aid of the characteristic curves.

Since the characteristic curves are largely straight but, according to the new findings explained in this disclosure, aging causes their gradient to change, it is most preferable and expedient to measure the average value of the single ion signals at two different operating voltages, and from this to determine the slope of the characteristic curve, i.e. the ratio of the logarithmic increase in amplification to the linear increase in the operating voltage. This gradient of the characteristic curve can then be used to set the desired amplification.

The disclosure likewise relates to the use of a method, like the one described above, for imaging mass spectrometric analysis of a thin tissue section or mass spectrometric high-throughput analysis/massive-parallel analysis, as can be used in pharmaceutical research and development, for example.

The disclosure relates, furthermore, to a time-of-flight mass spectrometer (in axial operation or with orthogonal ion acceleration), whose control unit is programmed for the execution of a method as described above. The time-of-flight mass spectrometer is preferably coupled with a laser desorption ion source (LDI), for example an ion source for matrix-assisted laser desorption (MALDI).

DETAILED DESCRIPTION

Figure 1:
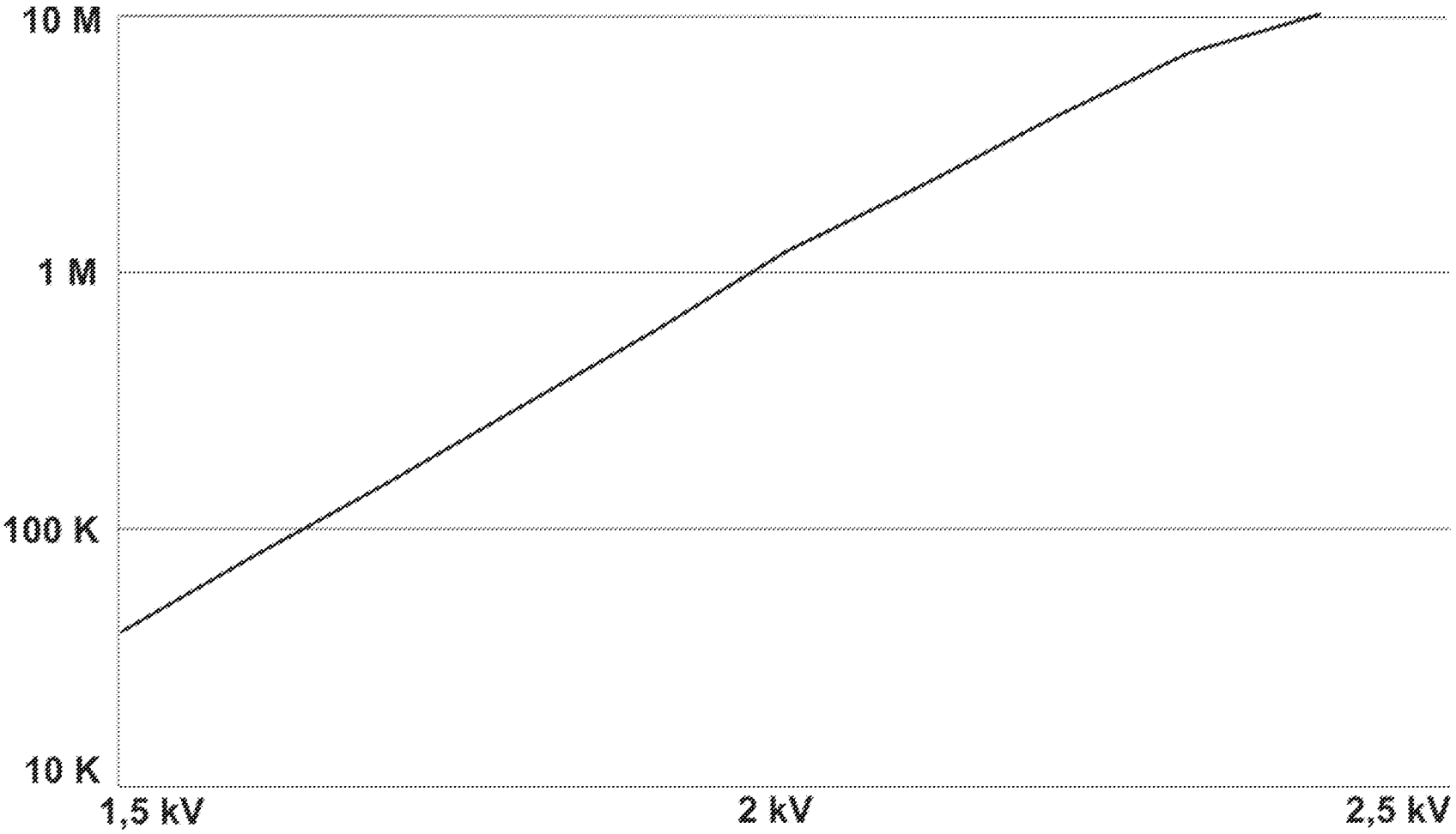
FIG. 1 shows a fresh characteristic curve of a conventional double multichannel plate in a chevron arrangement which consists of very fine channels only two micrometers in diameter. The amplification range is somewhat limited due to the very fine channels, but even here is between $4\times10^4$ and $1\times10^7$. Other types of multipliers have very similar characteristic curves.
Figure 2:
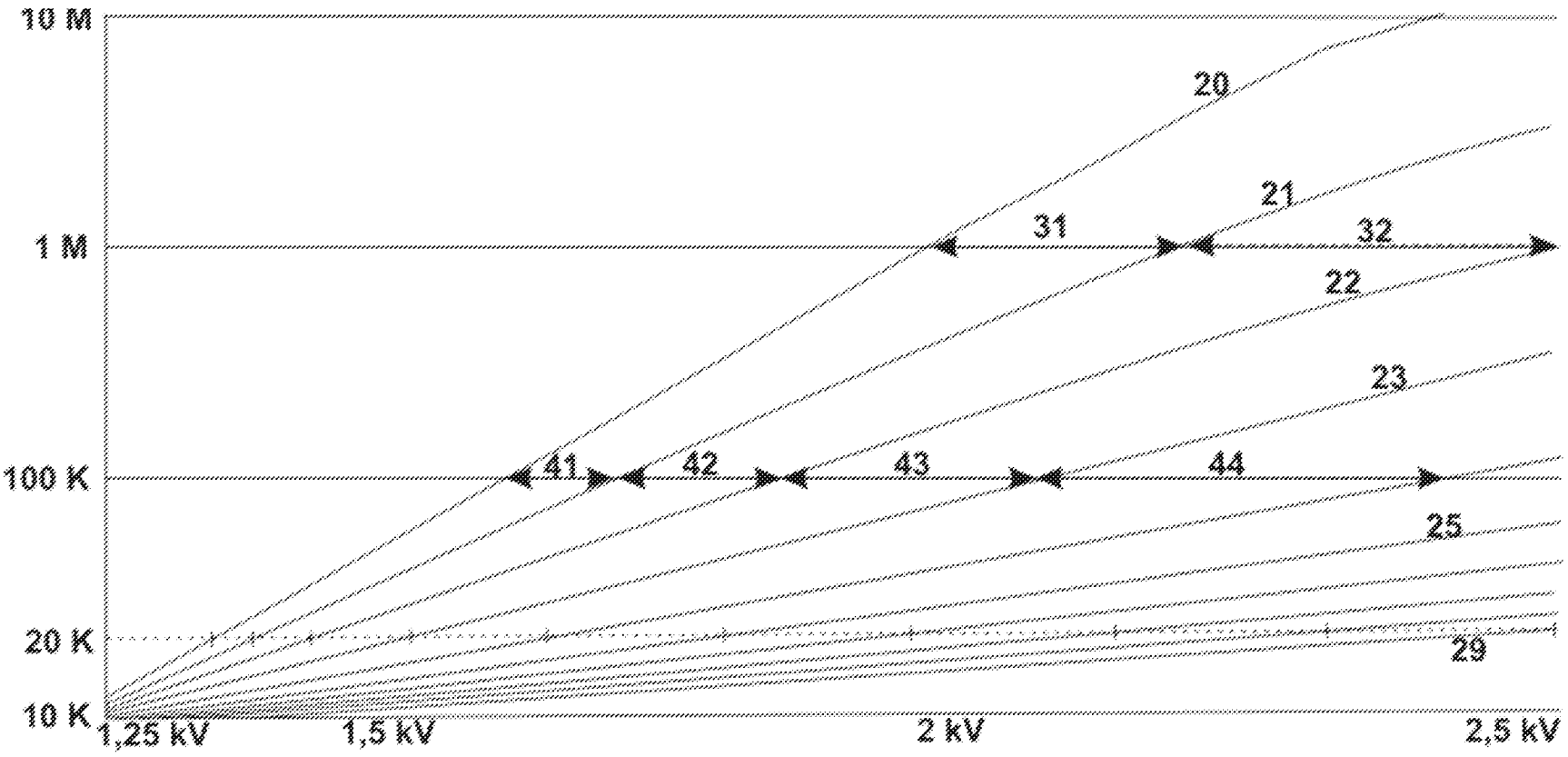
FIG. 2 is a theoretical representation, supported by measurements, of the change in the characteristic curves (20) to (29) as a multiplier ages. The representation is based on the characteristic curve in FIG. 1, and takes into account the fact that the aging (a) is faster, the higher the amplification at which the SEM is operated; and (b) is faster, the higher the operating voltage which must be set for a given amplification. It was, furthermore, assumed that the characteristic curves remain straight. The characteristic curves are arranged as they each result after a specific, identical operating time, for example periods of 100 hours in each case. If the SEM is operated at an amplification of $10^6$ (1 M), the SEM survives only two periods (31) and (32), thus in this example only around 200 hours; at an amplification of $10^5$ (100 K) it survives for around four periods (41) to (44); at an amplification of only $2\times10^4$ (20 K) it survives for nine periods (broken line). The characteristic curves necessarily change their gradient because of the assumptions (a) and (b). Hitherto it has generally been assumed that the slope of the characteristic curve remained constant as the aging progressed.
Figure 3:
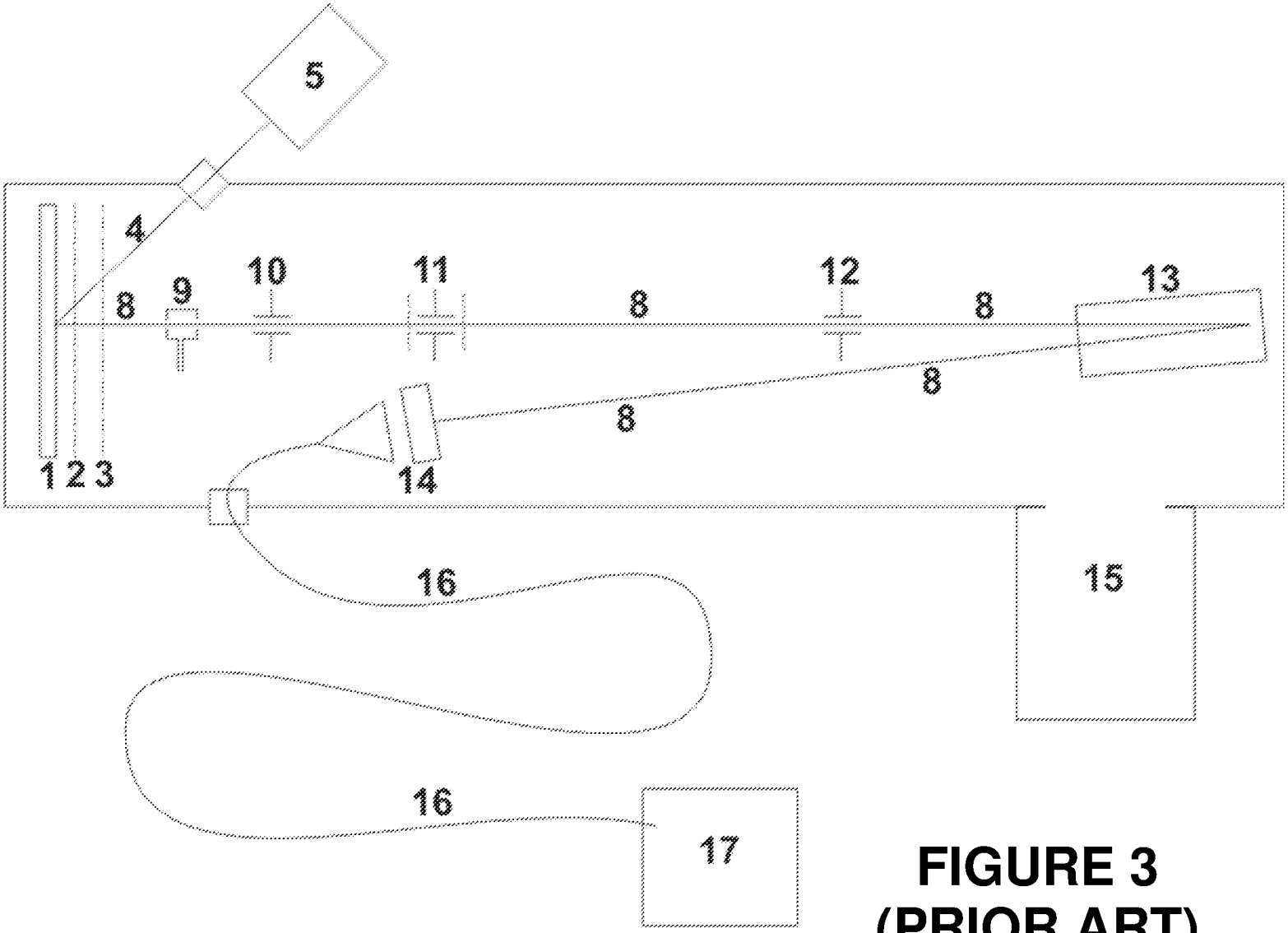
FIGURE 3 (PRIOR ART)
FIG. 3 is a schematic diagram of a conventional MALDI time-of-flight mass spectrometer according to the Prior Art. The samples are located on the sample support plate (1), opposite the accelerating electrodes (2) and (3), and can be ionized by the beam of laser light pulses (4) supplied by the laser (5). The ions are accelerated by the accelerating electrodes (2) and (3) to create an ion beam (8), which passes through a gas cell (9) which may, if required, be filled with collision gas, a parent ion selector (10), a daughter ion post-acceleration unit (11) and a parent ion suppressor (12), and is then reflected by the reflector (13) onto the ion detector (14). The mass spectrometer housing is evacuated by a powerful vacuum pump (15). In this example illustration, the ion detector (14) has a multichannel plate and a metal cone for reflection-free matching to a 50Ω coaxial cable (16). The 50Ω coaxial cable is several meters long and feeds the output current to a computer (17) containing the high-speed digitizing unit.
Figure 4:
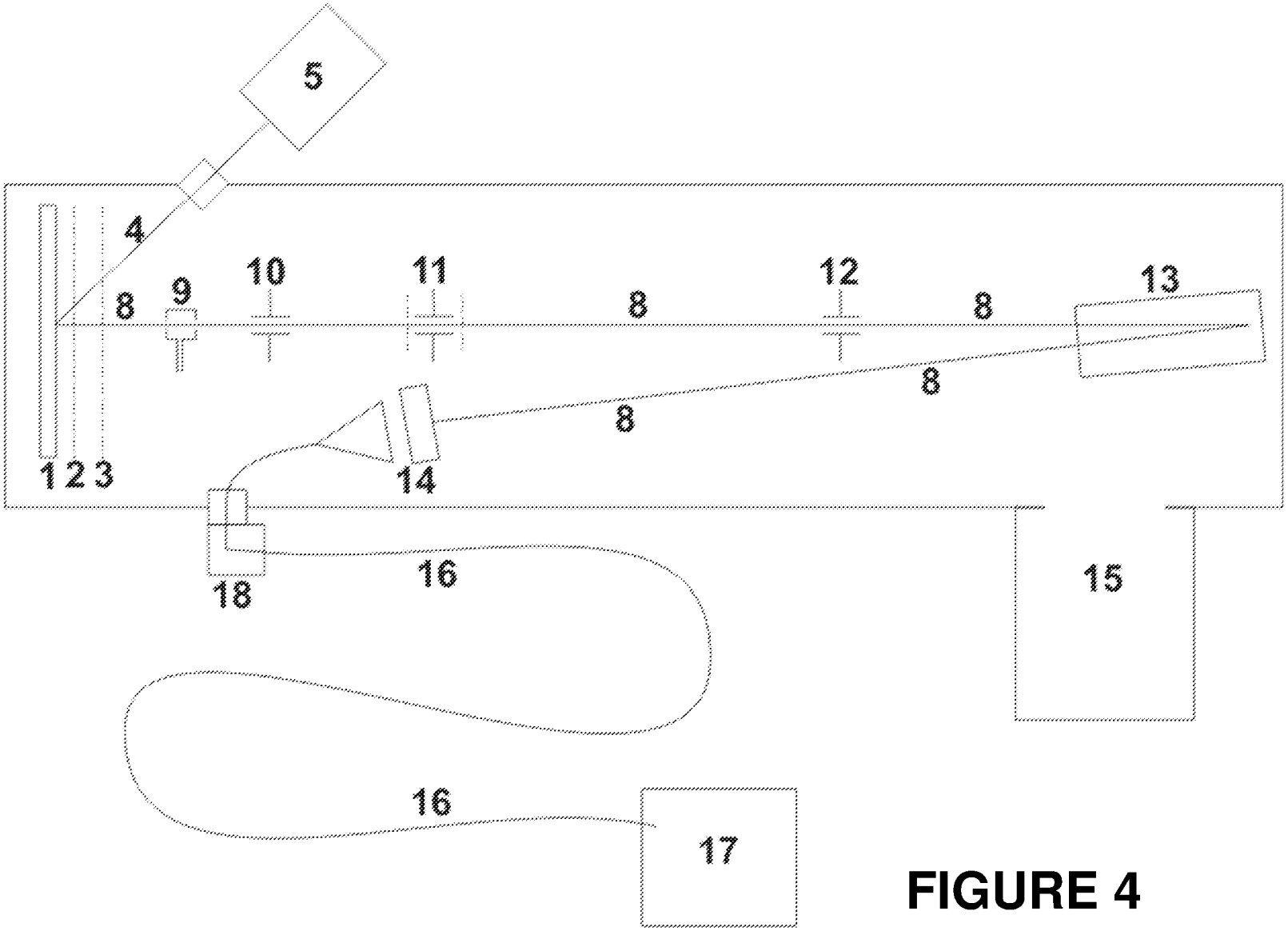
In FIG. 4, a preamplifier (18) is attached to the outside of the vacuum chamber, close to the detector (14), for example flange-mounted near the detector so that the SEM can be operated at a much lower amplification in order to prolong the service life. The separation between preamplifier (18) and detector (14) is preferably less than 40 centimeters, in particular less than 30 centimeters.
Figure 5:
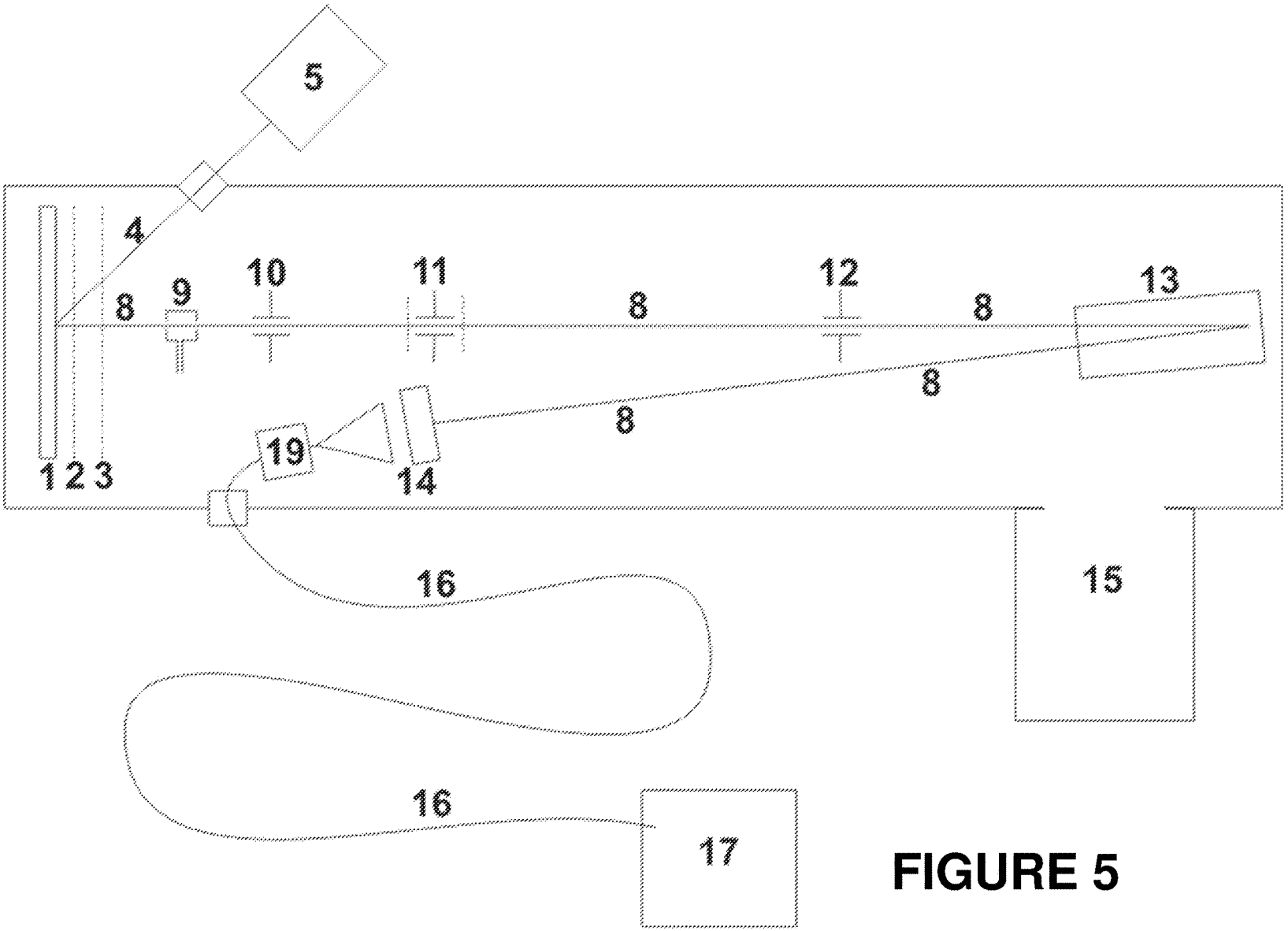
In FIG. 5, the preamplifier (19) is located in the vacuum system of the mass spectrometer, as close as possible to the detector (14), preferably less than 40 centimeters away, particularly less than 30 centimeters, thus facilitating a very low-noise operation.

FIG. 2 is a theoretical representation, supported by measurements, of the group of characteristic curves (20) to (29) for the aging of a multiplier. The graph shows how each characteristic curve changes after specific operating periods of the same duration, for example after a period of around 100 operating hours in each case. The representation is based on two observations: (a) The aging occurs faster, the higher the amplification at which the SEM is operated. It is highly probable that this is because the greater number of secondary electrons which impinge at the end of the SEM causes a greater change in the work function of the active surface. (b) The SEM ages faster, the higher the operating voltage which must be set for a given amplification. This is probably because the energy of the impinging electrons is higher. A higher electron density and a higher electron energy accelerate the damage to the active surfaces, so lower yields of secondary electrons are achieved. If the SEM is operated at an amplification of $10^6$ (1 M), the SEM only survives for two periods (31) and (32), thus in this example only around 200 hours of operation; at an amplification of $10^5$ (100 K) it survives for around four periods (41) to (44); at an amplification of only $2\times10^4$ (20 K) it survives for around nine periods (broken lines). The individual characteristic curves are more or less straight, but their gradient changes.

The service life of a secondary-electron multiplier (multiplier, SEM) can thus be greatly prolonged if one succeeds in operating it at a voltage which is far below the usual operating voltage for SEMs. When the multiplier is operated at an amplification of $10^5$, or even only $2\times10^4$, for example, instead of the usual amplification of around $10^6$, it should be possible to extend the service life by a factor of three to five, since the service life depends to a great extent on the current intensity of the emitted electrons and the amplitude of the operating voltage.

However, at a low operating voltage, the pulse current of secondary electrons generated by a single ion is not sufficient to produce a digital signal which clearly stands out from the noise and can be unambiguously identified at the input of the digitizing unit. The digitizing unit generates four to six digital values in one nanosecond, depending on the type. Several computing cycles are required to address and store a digital value, however, so that even in very fast computers with $2\times10^9$ operations per second, several independent databases have to be set up, to which the measurement data are fed in turn with overlap. For these reasons, the digitizing unit is accommodated in the computer of the mass spectrometer, which can be located several meters from the mass spectrometer itself. Additional electronic noise is generated by the line carrying the output signal of the SEM to the computer, which is several meters long, usually via a 50Ω coaxial cable.

As has already been explained above, it has been found that the signal-to-noise ratio at the input of the distant digitizing unit can be improved by amplifying the output signal of the SEM at a sufficiently low noise level by means of a preamplifier located close to the SEM, and by operating the SEM at a correspondingly lower operating voltage so that the service life of the SEM is prolonged many times over. Since operating a preamplifier in a vacuum is a particularly low-noise mode of operation, the preamplifier may be even located in the vacuum system of the mass spectrometer, if possible, but at least on the housing of the vacuum system. The preamplifier must, however, operate at a high enough speed so as not to distort the electron current pulses. Preamplifiers of this type with a sufficiently large bandwidth are commercially available, see for example the TA2400 model from FAST ComTech GmbH (Oberhaching, Germany). If required, the preamplifier must be designed so that it can be operated in a vacuum.

The preamplifier can be operated at a particularly low noise level by cooling it to temperatures of −50 to −20 degrees Celsius, for example. To this end, a Peltier element or other suitable cooling element, thermally coupled to the preamplifier, can be used, for example.

The preamplifier selected must satisfy several criteria. First, the amplifier has to have sufficient bandwidth to amplify the pulse currents of secondary electrons without any distortion. The pulses from individual ions have full width at half-maximum values below one nanosecond. Furthermore, the amplifier must operate with very little noise. Since the preamplifiers generally contribute more noise, the greater the amplification, a compromise must be made between amplification and low noise. Experiments have shown that an amplifier with twenty-fold amplification produces too much noise, while an amplifier with only five-fold amplification operates at a sufficiently low noise level. The optimum is probably an amplification of around five to ten-fold. Optimum adjustment of the electronics may allow the SEM to be operated at an amplification of only $1\times10^4$.

The operating voltage can be adjusted by a method which is explained in the aforementioned DE 10 2008 010 118 B4 patent specification (corresponding to GB 2457559 B or U.S. Pat. No. 8,536,519 B2). This method of reproducibly adjusting the amplification of a secondary-electron multiplier in a mass spectrometer essentially comprises the following steps:

(a) acquisition of a mass spectrum with single ion signals;

(b) calculation of the average peak height of the single ion signals;

(c) adjustment of the supply voltage of the secondary-electron multiplier so that the average peak height assumes a specified value for the single ion signals. The desired amplification is set via the operating voltage with the aid of the characteristic curves.

Since the characteristic curves are largely straight but, according to the findings of this disclosure, aging causes their gradient to change, it is expedient to measure the average value of the single ion signals at two different operating voltages, and to determine the slope of the characteristic curve, i.e. the ratio of the logarithmic increase in amplification to the linear increase in the operating voltage. This gradient of the characteristic curve can then be used to set the desired amplification.

In order to obtain mass spectra with a sufficient number of single ion signals, it is expedient to detune the temporal and/or spatial focusing of the mass spectrometer so that its resolution becomes extremely poor and the normally well-resolved ion signals for ions of the same mass change to a broad overlapping mixture. Moreover, the number of ions reaching the detector in any mass spectrometer can be greatly reduced until predominantly only single ion signals with no overlapping appear in the mass spectrum. This can be achieved by, for example, reducing the generation rate of the ions in the ion source or restricting the ion transmission through the mass spectrometer. In mass spectrometers which operate with ion traps or temporary stores, the filling quantities can be greatly reduced. All these measures serve to reduce the mass spectrum to signals which are significantly above the electronic background noise and can be assigned to individual ions. It is irrelevant whether these single ion signals originate from ions from the usual chemical noise background or from analyte ions.

It is not essential that the mass spectrum no longer contains any signals whatsoever from ion accumulations. The width of the single ion signals means that they can be identified and read out quite well.

The mass spectrum is scanned in the usual way, amplified by the SEM and electronic amplifiers, digitized and digitally stored. In this digitized mass spectrum, the single ion signals can be easily recognized by their peak widths, using a suitable computer program, and their peak heights as a function of the operating voltage can be investigated. The desired amplification is then set via the average values of the peak heights and the determination of the gradient of the characteristic curve.

The invention claimed is:

1. A method to operate a secondary-electron multiplier having at least one multichannel plate in an ion detector of a time-of-flight mass spectrometer in order to prolong the service life, comprising:

supplying the secondary-electron multiplier with an operating voltage in such a way that an amplification of less than $10^5$ secondary electrons per impinging ion is maintained, and amplifying an output current of the secondary-electron multiplier using an electronic pre-amplifier mounted in a vacuum system of the time-of-flight mass spectrometer in which the secondary-electron multiplier is located, or on a housing of said vacuum system, wherein a pre-amplifier amplification is chosen such that a resultant noise level allows current pulses generated by individual ions impinging on the ion detector to be detected above the noise at an input of a digitizing unit.

2. The method according to claim 1, wherein the digitizing unit operates at a digitizing rate of around four gigasamples per second or more.

3. The method according to claim 1, wherein the amplification of the secondary-electron multiplier is set to a maximum of $2\times10^4$ secondary electrons per impinging ion.

4. The method according to claim 1, wherein the preamplifier is flange-mounted on the housing of the vacuum system.

5. The method according to claim 1, wherein operation of the preamplifier is improved by cooling the preamplifier.

6. The method according to claim 5, wherein cooling is effected by a Peltier element or other suitable cooling element, which is thermally coupled to the pre-amplifier.

7. The method according to claim 5, wherein the pre-amplifier is cooled to temperatures of −50 to −20 degrees Celsius.

8. The method according to claim 1, wherein improved amplification is achieved by mounting the preamplifier less than 40 centimeters from the secondary-electron multiplier.

9. The method according to claim 1, wherein an adjustment of the amplification is implemented via the acquisition of a mass spectrum with individual ion signals at specific times of the operation of the secondary-electron multiplier.

10. The method according to claim 9, wherein the desired amplification of the secondary-electron multiplier is set via a characteristic curve which reflects the logarithm of the amplification as a function of the operating voltage.

11. The method according to claim 10, wherein two different operating voltages are used to determine the gradient of the characteristic curve and to adjust the amplification.

12. The method according to claim 1, wherein the digitizing unit is one of (i) housed in a computer of the time-of-flight mass spectrometer, which is located several meters from the time-of-flight mass spectrometer itself, and (ii) accommodated in a plug-in module in the time-of-flight mass spectrometer itself, which is located around half a meter to one meter from the secondary-electron multiplier.

13. The method according to claim 12, wherein the secondary-electron multiplier is connected to a computer by a long lead carrying the output signal of the secondary-electron multiplier to the computer.

14. The method according to claim 13, wherein the lead is a 500 coaxial cable.

15. The method according to claim 1, wherein the pre-amplifier is designed so that it can be operated in a vacuum.

16. The method according to claim 1, wherein the at least one multichannel plate is a double multichannel plate in a chevron arrangement.

17. A time-of-flight mass spectrometer whose control unit is programmed to execute a method according to claim 1.

18. The time-of-flight mass spectrometer according to claim 17, further comprising a laser desorption ion source (LDI) to which the spectrometer is coupled.

19. The time-of-flight mass spectrometer according to claim 18, wherein the laser desorption ion source is an ion source for matrix-assisted laser desorption (MALDI).

20. A method to operate a secondary-electron multiplier having at least one multichannel plate in an ion detector of a time-of-flight mass spectrometer in order to prolong the service life, during an imaging mass spectrometric analysis of a thin tissue section or a mass spectrometric high-throughput analysis/massive-parallel analysis, comprising:

supplying the secondary-electron multiplier with an operating voltage in such a way that an amplification of less then $10^5$ secondary electrons per impinging ion is maintained, and amplifying an output current of the secondary-electron multiplier using an electronic pre-amplifier mounted in a vacuum system of the time-of-flight mass spectrometer in which the secondary-electron multiplier is located, or on a housing of said vacuum system, wherein a pre-amplifier amplification is chosen such that a resultant noise level allows current pulses generated by individual ions impinging on the ion detector to be detected above the noise at an input of a digitizing unit.

* * * * *